US005615546A

United States Patent [19]

Althaus et al.

[11] Patent Number: 5,615,546

[45] Date of Patent: Apr. 1, 1997

[54] METHOD AND APPLIANCE FOR COOLING A GAS TURBINE COMBUSTION CHAMBER

[75] Inventors: Rolf Althaus, Kobe, Japan; Jakob J. Keller, Redmond, Wash.; Burkhard Schulte-Werning, Basel, Switzerland

[73] Assignee: ABB Management AG, Baden, Switzerland

[21] Appl. No.: 323,688

[22] Filed: Oct. 17, 1994

[30] Foreign Application Priority Data

Oct. 18, 1993 [DE] Germany ..... 43 35 413.0

[51] Int. Cl.[6] ..... F23R 3/02

[52] U.S. Cl. ..... 60/39.02; 60/752

[58] Field of Search ..... 60/752, 755, 756, 60/757, 39.02

[56] References Cited

U.S. PATENT DOCUMENTS

| | | | |
|---|---|---|---|
| 3,408,812 | 11/1968 | Stenger | 60/757 |
| 3,777,484 | 12/1973 | Dibelius et al. | 60/757 |
| 4,071,194 | 1/1978 | Eckert et al. | 60/755 |
| 4,292,376 | 9/1981 | Hustler | 60/755 |
| 4,302,941 | 12/1981 | Dubell | 60/755 |
| 4,339,925 | 7/1982 | Eggmann et al. | 60/757 |
| 4,446,693 | 5/1984 | Pidcock et al. | 60/757 |
| 4,653,279 | 3/1987 | Reynolds | 60/755 |
| 5,027,604 | 7/1991 | Krueger | 60/752 |

FOREIGN PATENT DOCUMENTS

| | | | |
|---|---|---|---|
| 0244693 | 11/1987 | European Pat. Off. . | |
| 1952436 | 6/1971 | Germany . | |
| 2907918 | 1/1980 | Germany . | |
| 3143394A1 | 6/1982 | Germany . | |
| 23508 | 6/1913 | Norway | 60/755 |

*Primary Examiner*—Timothy S. Thorpe
*Attorney, Agent, or Firm*—Burns, Doane, Swecker & Mathis, L.L.P.

[57] ABSTRACT

In a gas turbine combustion chamber cooled by means of impingement and convection cooling or pure convection cooling, a compensating flow of the cooling air is guided between adjacent cooling ducts (2) in such a way that the flow velocity in the cooling duct (2) always exceeds a critical limiting value even downstream of a local damage location (6) so that the temperature is less than a critical limiting value. The compensating flow is led past the combustion chamber outer wall. Connecting openings (5) are arranged between adjacent cooling ducts (2) and are respectively offset on the opposite sides of the cooling duct (2).

3 Claims, 1 Drawing Sheet

METHOD AND APPLIANCE FOR COOLING A GAS TURBINE COMBUSTION CHAMBER

BACKGROUND OF THE INVENTION

1. Field of the Invention

The invention relates to a method and an appliance for cooling a gas turbine combustion chamber cooled by means of impingement and convection cooling or pure convection cooling.

2. Discussion of Background

In modern gas turbine combustion chambers, cooling methods which require little or, indeed, no cooling air are increasingly being used. Because $NO_x$ emissions have to be avoided as far as possible, efforts are made to pass as much air as possible through the burner. For this reason, combinations of impingement and convection cooling systems or pure convection cooling systems are employed with ever increasing frequency. In the case of an unfavorable design, such systems can have the problematic property that small primary damage, for example a small hole in the combustion chamber wall, can lead to very large consequential damage which endangers the operation of the gas turbine. As an example, a hole in a cooling duct can lead to the cooling duct being inadequately supplied with air downstream of the hole. This can lead to damage to the whole duct downstream of the hole or even to more extensive damage.

SUMMARY OF THE INVENTION

The invention attempts to avoid all these disadvantages and, accordingly, one object of the invention is to provide, in a gas turbine combustion chamber cooled by means of impingement and convection cooling or pure convection cooling, a novel method and an appliance for cooling, which method and appliance make it possible to prevent a further increase in the damage when fairly small local damage, for example holes, occurs in the cooling duct.

This is achieved in the invention, in a method for cooling the gas turbine combustion chamber as described in detail below, by guiding a compensating flow of the cooling air between the cooling ducts in such a way that the flow velocity in the damaged cooling duct always exceeds a critical limiting value downstream of the damage location so that the temperature is less than a critical limiting temperature.

This is achieved in the invention, in an appliance for cooling the gas turbine combustion chamber, by arranging connecting openings between adjacent cooling ducts, the connecting openings being respectively offset on the opposite sides of the cooling duct.

The advantages of the invention may, inter alia, be seen in that a chain reaction is avoided when local damage occurs in the cooling duct and "self-healing" of the damaged cooling duct takes place.

It is particularly expedient for the compensating flow to be guided along the combustion chamber outer wall because cooling film flows then form on the outer wall and these cool the outer wall intensively and completely in the region of the damage location.

It is, furthermore, advantageous for the web lengths and the opening lengths of the connecting openings to be equally large because favorable cooling relationships are achieved by this means.

Finally, the connecting openings are advantageously provided in the cooling ribs.

It is expedient for the connecting openings between the cooling ducts to be dimensioned in such a way that the product of the average opening width and the cooling duct length, referred to the cross-sectional area of the cooling duct, is located in the range between 2 and 8. The most effective cooling can then be achieved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which show an embodiment example of the invention using a sealed gas turbine combustion chamber and wherein.

DESCRIPTION OF THE PREFERRED EMBODIMENTS

Figure 1:
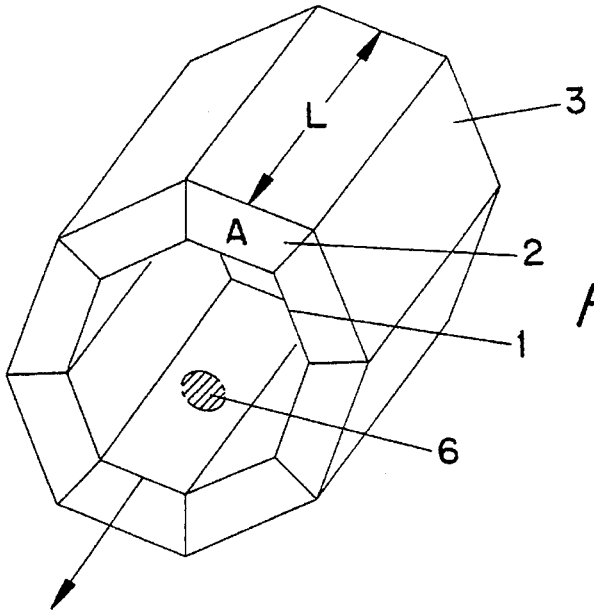
FIG. 1 shows a simplified perspective representation of the gas turbine combustion chamber.

Referring now to the drawings, wherein only the elements essential to understanding the invention are shown, wherein the flow direction of the cooling air is indicated by arrows and wherein like reference numerals designate identical or corresponding parts throughout the several views, the invention is explained in more detail below using an embodiment example and FIGS. 1 to 3.

Figure 2:
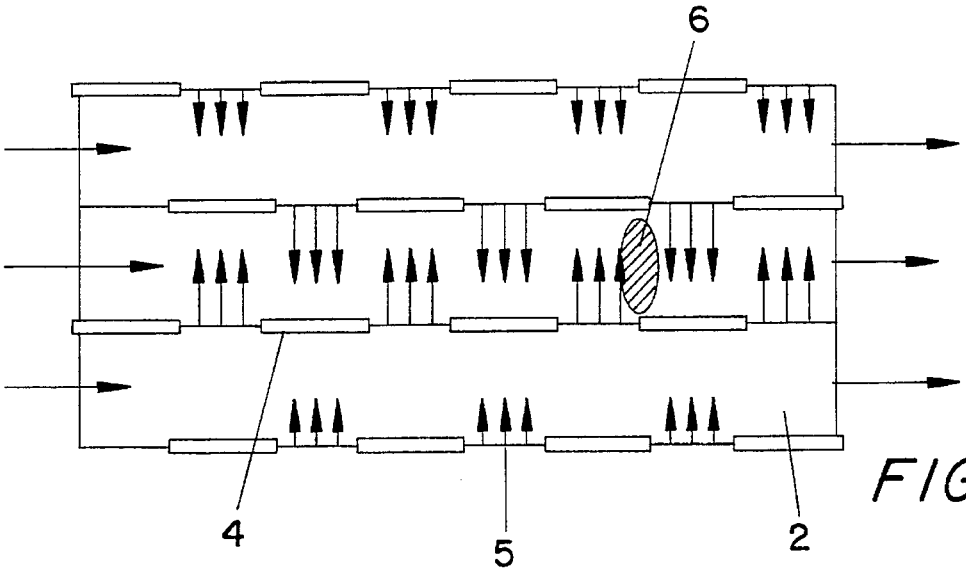
FIG. 2 shows a part of the cooling ducts of the combustion chamber.

A gas turbine combustion chamber is represented in a simplified manner in FIG. 1. A convection cooling system is used for cooling the combustion chamber wall 1. The whole of the cooling air flows along in cooling ducts 2 between the outer wall 3 and the combustion chamber wall 1 before it is supplied to the combustion chamber as combustion air. As may be seen from FIG. 2, cooling ribs 4 are located between the cooling ducts 2 and connecting openings 5, according to the invention, are present in these cooling ribs 4. These connecting openings 5 are arranged respectively offset on the opposite sides of a cooling duct 2.

Figure 3:
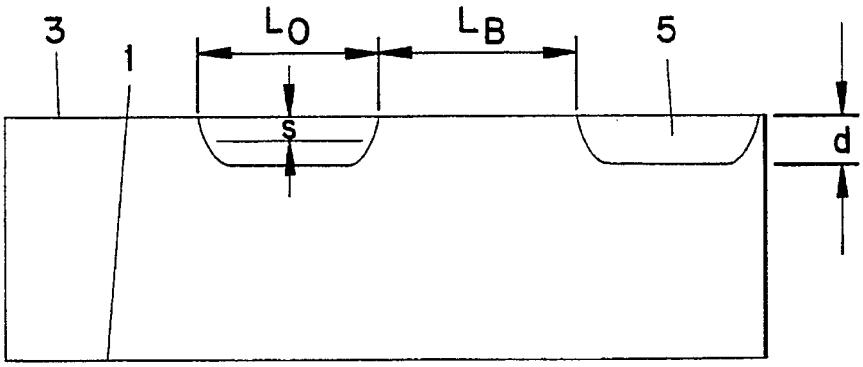
FIG. 3 shows a longitudinal section through a cooling duct.

FIG. 3 shows, in a partial longitudinal section, that the web length $L_B$ and the opening length $L_O$ are of approximately equal size. The average gap width s between two adjacent cooling ducts 2 is given by the equation $$s = \frac{L_O d}{L_O + L_B}$$

where d =width of the opening $L_O$ =opening length $L_B$ =web length

The dimensioning of the connecting openings 5 between the cooling ducts 2 advantageously takes place in accordance with the design rule $$2 < sL/A < 8,$$

i.e. the product of the average opening width s between two cooling ducts 2 and the cooling duct length L, referred to the cross-sectional area A of the cooling duct 2, is located in the range greater than 2 and smaller than 8. If the product is less than the lower limit of this interval, a very large hole can lead to overheating of the cooling duct 2 downstream of the hole. If the upper value is markedly exceeded, a very large hole or a longitudinal slot in one or more cooling ducts can lead to such a high loss of air that the burners locally overheat the primary zone of the combustion chamber during full-load operation.

During operation of the gas turbine combustion chamber, local material damage can occur in the cooling ducts, for example a local damage location 6 in the form of a small hole can form in the combustion chamber wall 1. In conventional gas turbine combustion chambers, which are cooled by combined impingement and convection cooling systems or by pure convection cooling systems in accordance with the prior art, the danger then exists that this small damage location 6 may lead to large consequential damage because the cooling duct 2 is no longer adequately supplied with cooling air downstream of the hole.

This chain reaction is prevented, however, in the present embodiment example according to the invention because a compensating flow is generated between the cooling ducts 2 by the connecting openings 5 and this leads to the effect that the flow velocity of the cooling air in the damaged cooling duct 2 is never less than a critical limiting value even downstream of the local damage location 6 which insures that the temperature cannot exceed a critical limiting value.

The offset arrangement of the connecting openings 5 ensures that air from at least one adjacent duct can flow into the damaged cooling duct 2 at each axial position. The compensating flow then takes place on the combustion chamber outer wall 3.

Should a hole be present in the combustion chamber inner wall 1, cooling film flows form along the outer wall 3 and these cool the cooling duct 2, and particularly the outer wall 3, intensively and completely in the region of the local damage location 6 (hole). Further growth of the hole can be avoided by this means. "Self-healing" of the damaged cooling duct takes place. The invention is of particularly great importance in the case of thin combustion chamber walls with high thermal loads.

Obviously, numerous modifications and variations of the present invention are possible in light of the above teachings. It is therefore to be understood that within the scope of the appended claims, the invention may be practised otherwise than as specifically described herein.

LIST OF DESIGNATIONS

1 Combustion chamber wall
2 Cooling duct
3 Outer wall
4 Cooling rib
5 Connecting opening
6 Local damage location
$L_O$ Opening length
$L_B$ Web length
s Average opening width
L Cooling duct length
A Cross-sectional area of a cooling duct
d Width of the opening

What is claimed as new and desired to be secured by Letters Patent of the United States is:

1. A method for cooling a gas turbine combustion chamber having local damage in a wall enclosing the combustion chamber causing a loss of cooling air, the combustion chamber having a plurality of cooling ducts, adjacent cooling ducts being separated by cooling ribs, wherein comprising the steps of:

guiding a main flow of cooling air in cooling air ducts for at least a convection cooling flow along a wall of the combustion chamber;

guiding a compensating flow of cooling air from adjacent cooling ducts to a duct having local damage in a wall of the combustion chamber causing a loss of cooling air from the duct, the compensating flow being provided in an amount sufficient to maintain in the duct having local damage a flow velocity of the cooling air above a predetermined critical limiting value and a temperature of the cooling air below a predetermined critical limiting temperature, wherein an increase in the local damage to the wall is substantially avoided.

2. The method as claimed in claim 1, wherein cooling air is guided in the cooling ducts for combined convection cooling flow along the wall and impingement cooling flow striking the wall.

3. The method as claimed in claim 1, wherein the combustion chamber has an inner and an outer wall and wherein the compensating flow to the cooling duct having local damage is guided transverse to the combustion chamber outer wall.

* * * * *